US012751561B1

(12) United States Patent
Anderson

(10) Patent No.: US 12,751,561 B1
(45) Date of Patent: Oct. 6, 2026

(54) REMOVABLE TRAY FOR HIGH CHAIR

(71) Applicant: Britta Anderson, Swanzey, NH (US)

(72) Inventor: Britta Anderson, Swanzey, NH (US)

( * ) Notice: Subject to any disclaimer, the term of this patent is extended or adjusted under 35 U.S.C. 154(b) by 79 days.

(21) Appl. No.: 18/932,543

(22) Filed: Oct. 30, 2024

Related U.S. Application Data

(60) Provisional application No. 63/603,505, filed on Nov. 28, 2023.

(51) Int. Cl.
*A47D 1/00* (2006.01)
*A47D 15/00* (2006.01)

(52) U.S. Cl.
CPC ..... *A47D 1/0085* (2017.05); *A47D 15/006* (2013.01)

(58) Field of Classification Search
CPC ..... A47D 1/0085; A47D 15/006; A47D 3/00; A47D 15/005; A47D 15/00; A47D 1/008; A44B 11/00; A44B 11/006
See application file for complete search history.

(56) References Cited

U.S. PATENT DOCUMENTS 1,270,029 A * 6/1918 Heule ..... A47D 1/0085 297/154
2,664,143 A * 12/1953 Alfonso ..... A47D 1/002 297/154
2,718,917 A * 9/1955 Johnson ..... A47D 1/0085 297/150
3,383,134 A * 5/1968 Webb ..... A47D 1/0085 297/153
3,788,699 A * 1/1974 Starr ..... A61G 5/10 5/652
4,971,389 A 11/1990 Staggs
5,087,097 A 2/1992 Hehn
(Continued)

FOREIGN PATENT DOCUMENTS

CA 2546212 A1 * 11/2006
CN 107898216 4/2018
(Continued)

OTHER PUBLICATIONS

English translation for DE-112015003555-T5 (Year: 2017).*
(Continued)

*Primary Examiner* — David R Dunn
*Assistant Examiner* — Troy Alan Libby
(74) *Attorney, Agent, or Firm* — Loginov & Associates, PLLC; William A. Loginov

(57) ABSTRACT

This invention provides a removable tray suitable for commonly available commercial/institutional wooden high chairs used in restaurants and similar venues. A tray assembly for a non-adjustable commercial high chair includes a polymer tray having a main surface and a surrounding apron located around the front and sides. A rear side of the tray is free of any apron, to allow a bottom face of the main surface to engage high chair armrests. A pair of opposing stop walls extend inwardly along the bottom face. A strap assembly extends from each of the sides, and includes a buckle arrangement that allows the strap assembly to be releasably attached around a high chair seat The bottom face includes stop walls that engage front edges of each of the armrests. The strap assembly includes two strap sides, each being attached through a slot in each of the sides of the tray.

14 Claims, 10 Drawing Sheets

(56) References Cited

U.S. PATENT DOCUMENTS

| | | | | |
|---|---|---|---|---|
| 5,118,161 | A | 6/1992 | Slowe | |
| 5,382,074 | A * | 1/1995 | Pietra | A47B 23/02 297/487 |
| D357,440 | S * | 4/1995 | Pietra | D12/133 |
| 5,458,394 | A | 10/1995 | Nichols | |
| 6,089,654 | A | 7/2000 | Burstein | |
| 6,216,605 | B1 | 4/2001 | Chapman | |
| 6,247,750 | B1 | 6/2001 | Tsai | |
| 6,659,544 | B2 * | 12/2003 | Hollett | A47D 1/004 297/118 |
| 6,920,830 | B1 * | 7/2005 | Asbach | A47D 1/0085 297/148 |
| 7,976,099 | B2 * | 7/2011 | Ferrara | B60N 3/002 297/135 |
| 8,408,650 | B2 | 4/2013 | Jacobs | |
| 9,420,899 | B2 | 8/2016 | Merlo | |
| 10,602,857 | B1 * | 3/2020 | Harris | A47D 1/0085 |
| 11,172,764 | B2 * | 11/2021 | Tackaberry | A47D 1/002 |
| 11,235,796 | B2 | 2/2022 | Giampavolo | |
| 2007/0145790 | A1 * | 6/2007 | Ventrola | A47D 1/0085 297/151 |
| 2013/0180936 | A1 | 7/2013 | Subbaraman | |
| 2016/0316932 | A1 | 11/2016 | Gomez | |
| 2018/0116423 | A1 | 5/2018 | Warjanka | |
| 2018/0263396 | A1 | 9/2018 | Flannery | |
| 2021/0402905 | A1 * | 12/2021 | Bruni | B60R 7/043 |
| 2023/0009216 | A1 * | 1/2023 | Rossman | A47D 1/0085 |

FOREIGN PATENT DOCUMENTS

| | | | | |
|---|---|---|---|---|
| DE | 112015003555 T5 * | 4/2017 | | A47B 13/16 |
| GB | 2465351 A | 5/2010 | | |

OTHER PUBLICATIONS

Furniture Knowledge Natural Leather High Chair Safety Strap Chair Seat Antique Vintage Baby Toddler Infant, https://furnitureknowledge.com/store/Natural-Leather-High-Chair-Safety-Strap-chair-seat-antique-vintage-baby-toddler-infant-p26103402, 7 pages, Jan. 1, 1991, Shawnee, KS.

Koala Kare Diner High Chair Tray (Grey) High Chair—KB851-01, https://www.totalrestroom.com/products/koala-kare-diner-high-chair-tray-grey-high-chair-kb851-01, Feb. 1, 2016, Centennial, CO.

Rubbermaid FG781588PLAT Tray for Sturdy Chair Youth Seat, Platinum, https://www.katom.com/007-781588PL.html, Jan. 1, 2022, Kodak, TN.

Smirthwaite Hardrock Chair, https://www.smirthwaite.co.uk/product/hardrock-chair, 13 pages, Jan. 1, 2023, Devon, United Kindom.

WebstaurantStore Restaurant High Chair Trays, Rubbermaid FG781588PLAT Platinum Restaurant High Chair Tray, https://www.webstaurantstore.com/43517/parts-and-accessories-for-high-chairs-and-booster-seats.html?filter=type: trays, Jun. 1, 2006, Huntersville, NC.

* cited by examiner

REMOVABLE TRAY FOR HIGH CHAIR

RELATED APPLICATION

The application claims the benefit of U.S. Provisional Application Ser. No. 63/603,505, entitled REMOVABLE TRAY FOR HIGH CHAIR, filed Nov. 28, 2023, the teachings of which are expressly incorporated herein by reference.

FIELD OF THE INVENTION

The invention relates to accessories for infant and toddler high chairs, and more particularly to trays for high chairs.

BACKGROUND OF THE INVENTION

High chairs are a ubiquitous feature in homes and establishments to assist in feeding infants and small children. In restaurants, and other commercial/institutional food service venues, a common type of high chair 100 for use by patrons is shown in FIG. 1. This type of high chair 100 is a robust, non-adjustable wood construction with four inwardly/upwardly tapering legs 110, 112, 114 and 116 that define a form of truncated pyramid. The legs 110, 112 and 114, 116 are tied together at various locations along their height by respective (front-to-rear) base supports 120, 122 and lateral, cross beams 130, 132 and 134. The elevated seat 140 is a solid plank secured between opposing stringers 142 and 144 that each extend between respective legs 110, 112 and 114, 116. Above the seat 140, a flat seat back 150 extends between rear legs 110 and 116 and a front bar 152 extends between front legs 112, 114. A webbing strap 160 extends between the bar 152 and front edge of the seat 140. This strap 160 defines leg slots, and otherwise prevents the child from slipping through the space between the bar 152 and seat 140. A pair of armrests 170 and 172 extend (front-to-rear) between the tops of legs 110, 112 and 114, 116, respectively. These armrests 170, 172, along with the bar 152 and back 150 serve to retain the child on all four sides (front, rear, left, and right) against slippage and/or falling from the chair 100. While the size and layout of the chair may vary to some extent between models and manufacturers, the general parameters of the seating area tend to be somewhat standardized.

This form of high chair 100 is relatively stable and highly durable. However, unlike home-based high chairs, it lacks a tray structure, compelling caregivers to serve the child meals at the dining table, which may be hard to reach by the child and has no lip to prevent spillage, or to simply hand feed items to the child and have them fall into his or her lap. The simple design of the high chair of FIG. 1 includes no accommodation for a tray or other serving surface.

It is desirable to provide a tray solution suitable for commonly available commercial/institutional non-adjustable wooden high chairs.

SUMMARY OF THE INVENTION

This invention overcomes disadvantages of the prior art by providing a removable (and portable) tray suitable for commonly available commercial/institutional wooden high chairs used in restaurants and similar venues. In an illustrative embodiment, a tray assembly for a non-adjustable commercial high chair is provided, and includes a polymer tray having a main surface and a surrounding apron located continuously around the front and sides thereof. A rear side of the tray is free of any apron, so as to allow a bottom face of the main surface to engage armrests of the commercial high chair. A pair of opposing stop walls extend inwardly along the bottom face from the apron, which are sized and arranged to interfere with front edges of each of the armrests in a predetermined front-to-rear position of the tray with respect to the high chair. A strap assembly extends from each of the sides, and includes a buckle arrangement that allows the strap assembly to be releasably attached around a seat of the high chair to removably secure the tray to the high chair. Illustratively, the bottom face includes stop walls that engage front edges of each of the armrests, and/or a top face of the main surface includes a surrounding, continuous raised lip. The bottom face can also define, at least in part, a textured surface that confronts each of the armrests. The rear side can define a concave curve and the front side can define a convex curve. The strap assembly can include two strap sides, each of the strap sides being attached through a slot in each of the sides of the tray. The strap sides can each include a sewn T-shaped end that engages each of the slots, respectively. In various embodiments, the high chair can comprise a non-adjustable wooden frame defining a truncated pyramid shape. The polymer tray can be constructed from at least one of HDPE, ABS, PVC, and PET as a unitary molded construction including the stop walls.

In another illustrative embodiment, a method for attaching a tray assembly to a non-adjustable commercial high chair is provided. The method employs a polymer tray having a main surface and a surrounding apron located continuously around the front and sides thereof, a rear side free of apron, a pair of opposing stop walls extending inwardly along the bottom face from the apron that, and a strap assembly extending from each of the sides and having a buckle arrangement. Armrests of the commercial high chair are engaged with a bottom face of the main surface. The stop walls are positioned to interfere with front edges of each of the armrests in a predetermined front-to-rear position of the tray with respect to the high chair. The strap assembly is releasably attached around a seat of the high chair to removably secure the tray to the high chair with the buckle arrangement. Illustratively, the high chair can comprise a non-adjustable wooden frame defining a truncated pyramid shape. Each of two interengaging buckle members can be fastened to releasably attach the assembly, and a free end of at least one strap can be tightened to remove slack from the buckled strap assembly. Conversely, each of two interengaging buckle members can be unfastened to remove the polymer tray from engagement with the non-adjustable commercial high chair.

BRIEF DESCRIPTION OF THE DRAWINGS

The invention description below refers to the accompanying drawings, of which.

DETAILED DESCRIPTION

Figure 1:
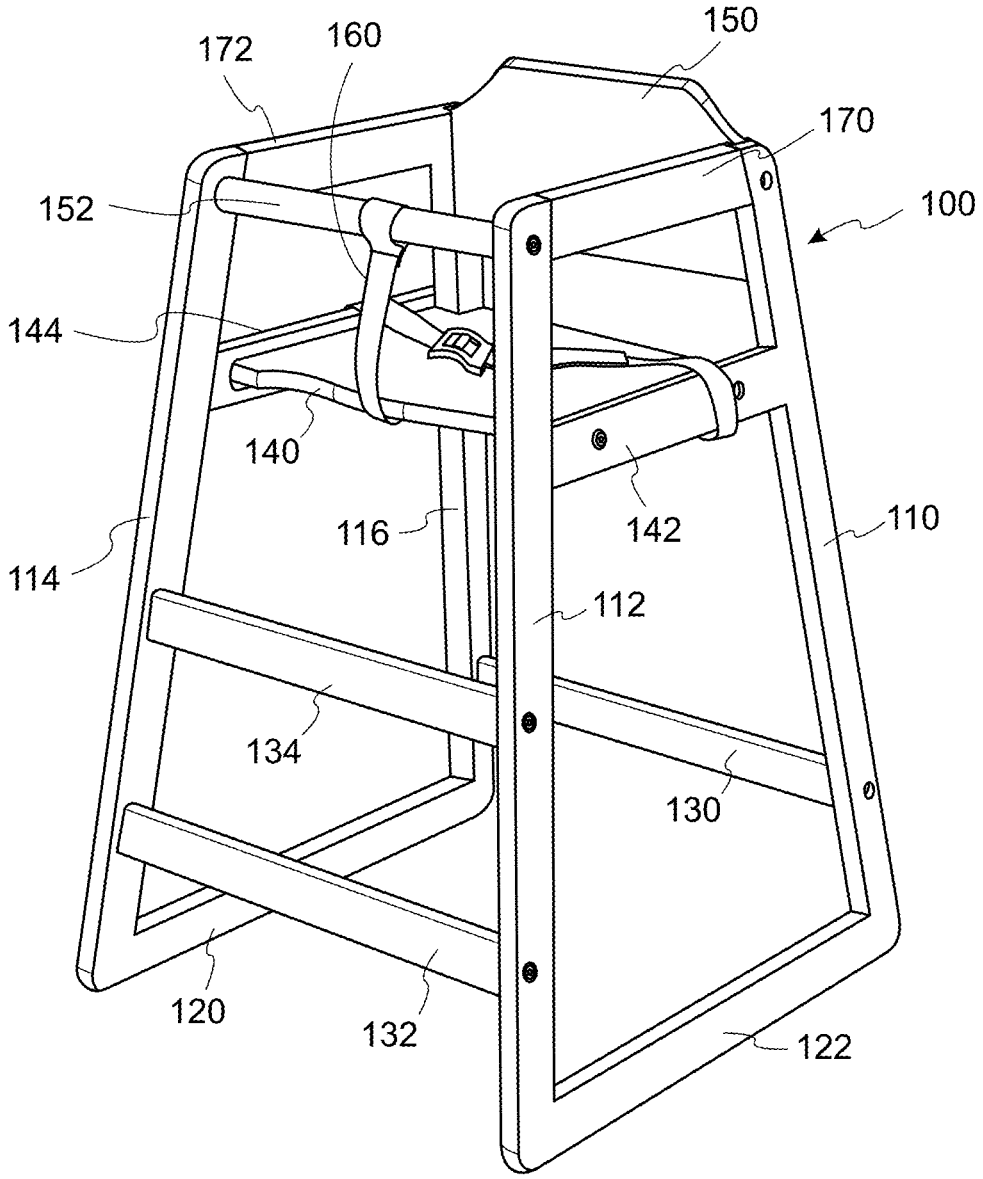
FIG. 1, already described, is a perspective view of a conventional, wooden, non-adjustable high chair commonly used in commercial restaurant settings.
Figure 2:
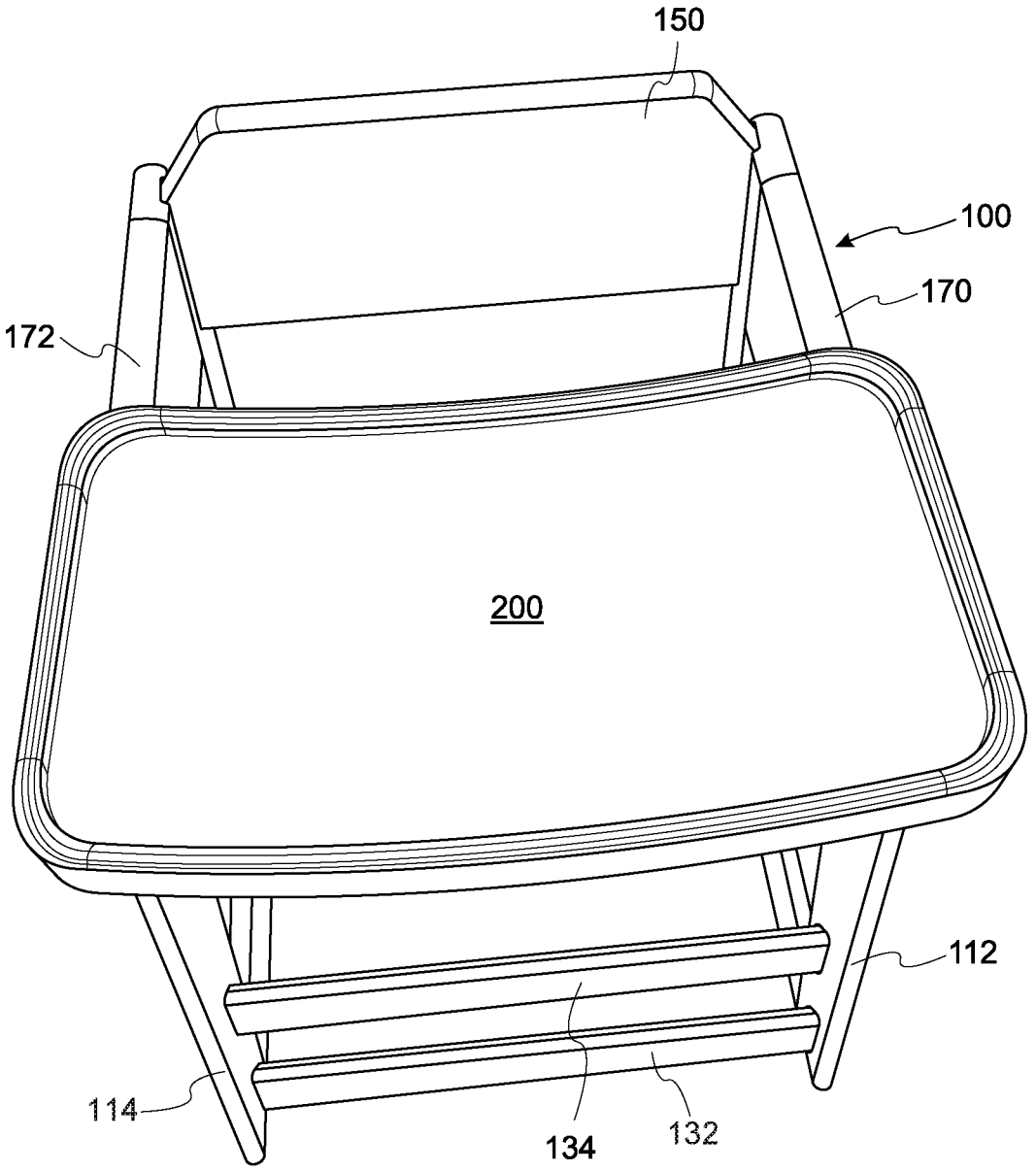
FIG. 2 is a top-oriented perspective view of a high chair of the type generally shown in FIG. 1 including a removable/portable tray assembly according to an illustrative embodiment.
Figure 3:
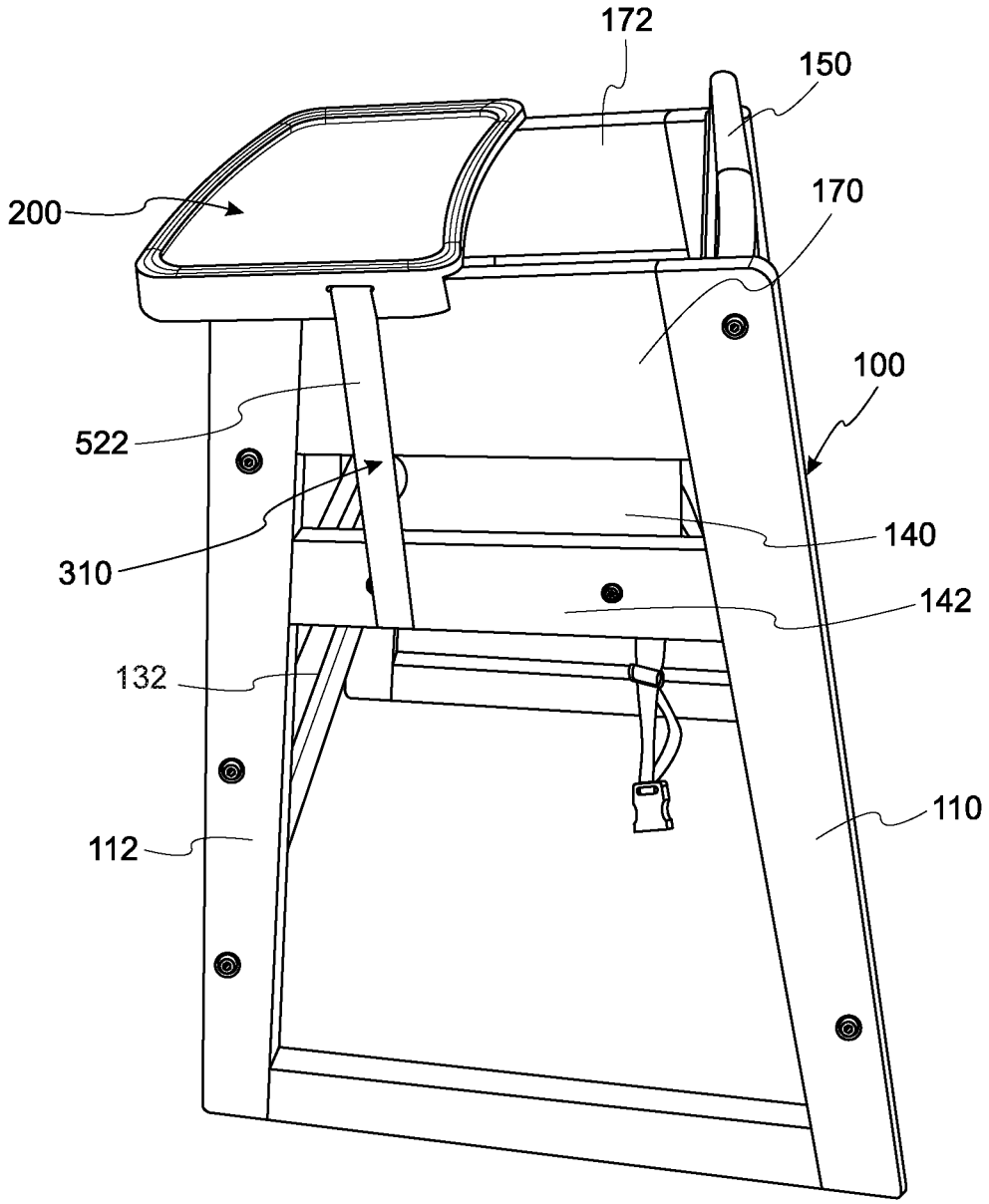
FIG. 3 is a left-oriented perspective view of the high chair and tray assembly of FIG. 2.
Figure 4:
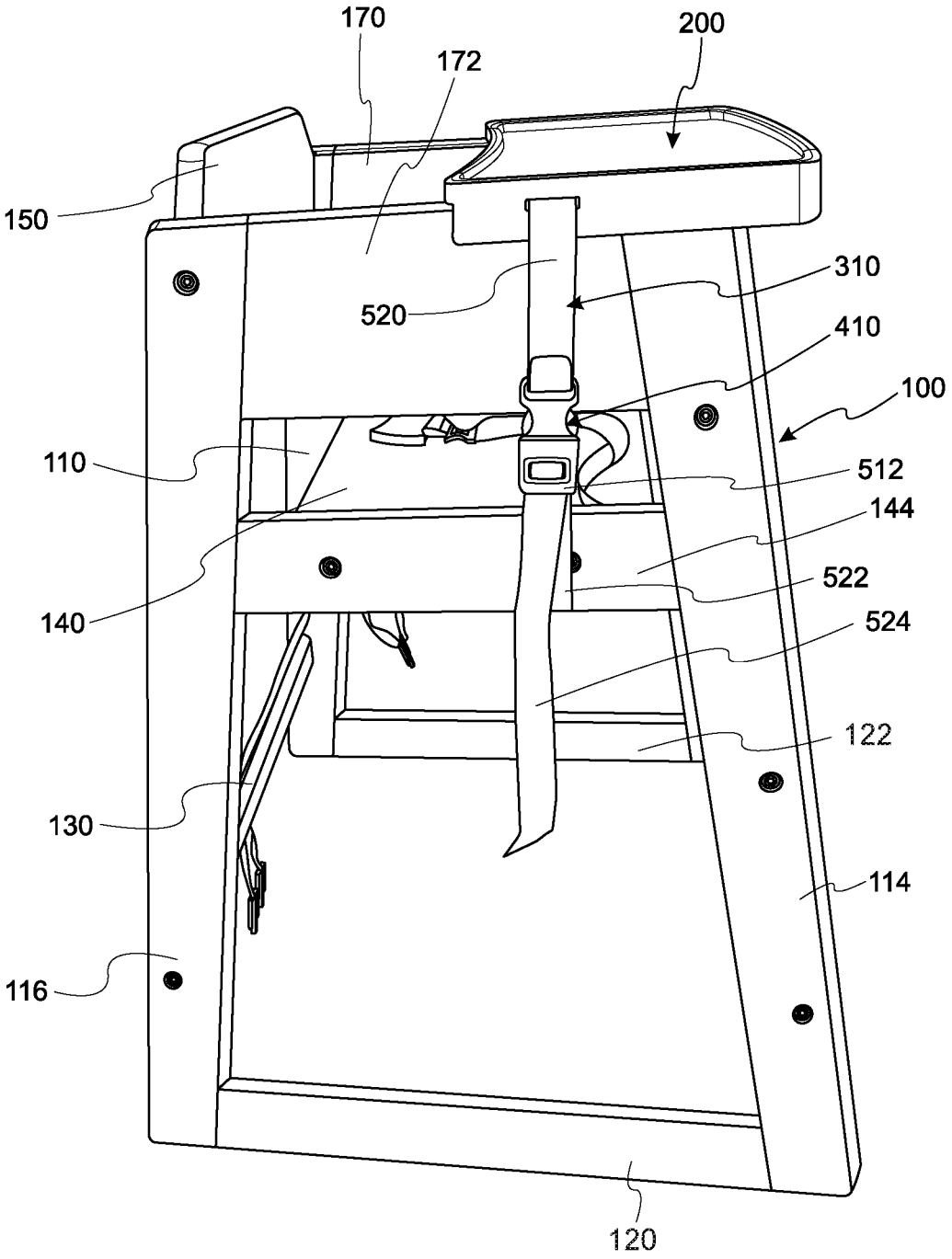
FIG. 4 is a right-oriented perspective view of the high chair and tray assembly of FIG. 2.

Reference is made to FIGS. 2-4, which show a conventional high chair as described above. A removable and portable tray assembly 200 is shown mounted on the chair. The tray assembly is adapted to engage the two opposing armrests 170, 172, and is removably secured in place by a webbing strap 310 (FIGS. 3 and 4) of appropriate length and width. By way of non-limiting example, the strap 310 can define an overall length of approximately 39-41 inches and a width of 1-1¼ inch, and illustratively 1 inch. The strap 310 is constructed from a commercially available woven or non-woven webbing using synthetic (e.g. nylon, polypropylene, etc.) and/or cotton thread. The strap 310 is secured around the stringers 142, 144 and seat 140 and adjustable to provide hold-down tension via a two-piece buckle assembly 410.

Figure 5:
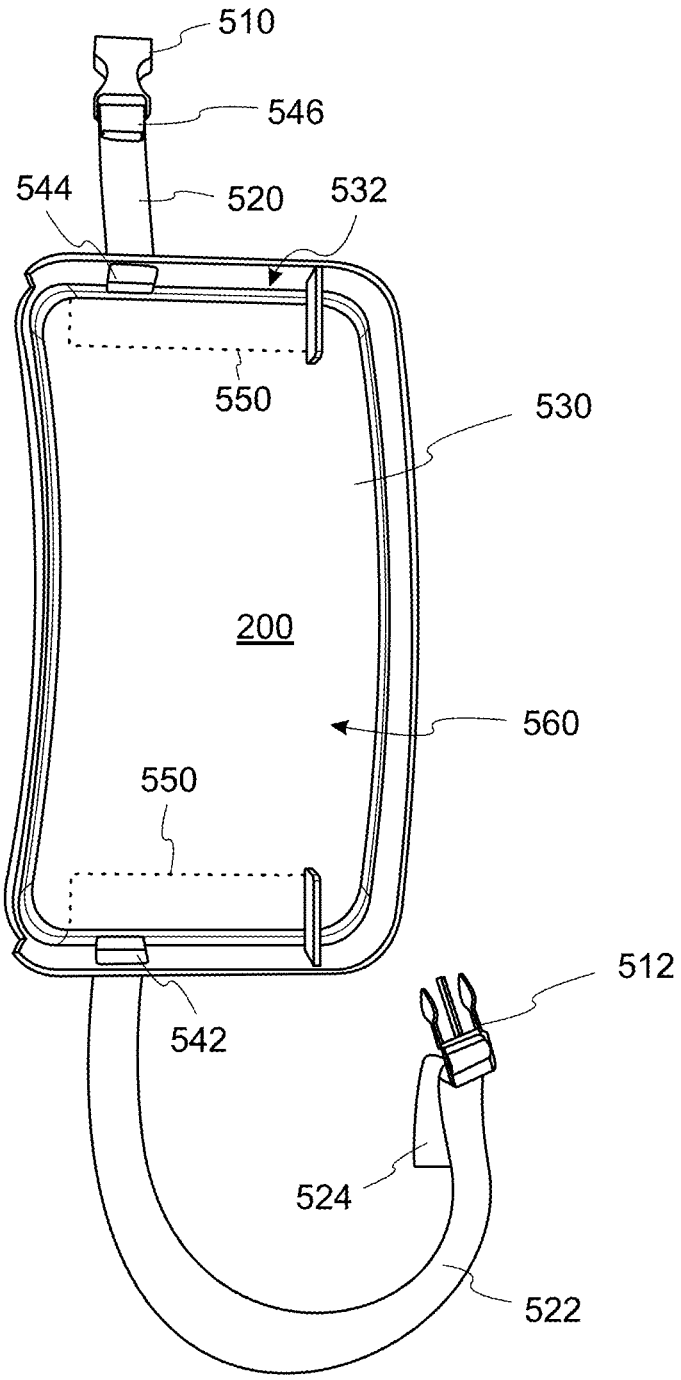
FIG. 5 is a bottom view of the tray assembly of FIG. 2, removed from the high chair.
Figure 6:
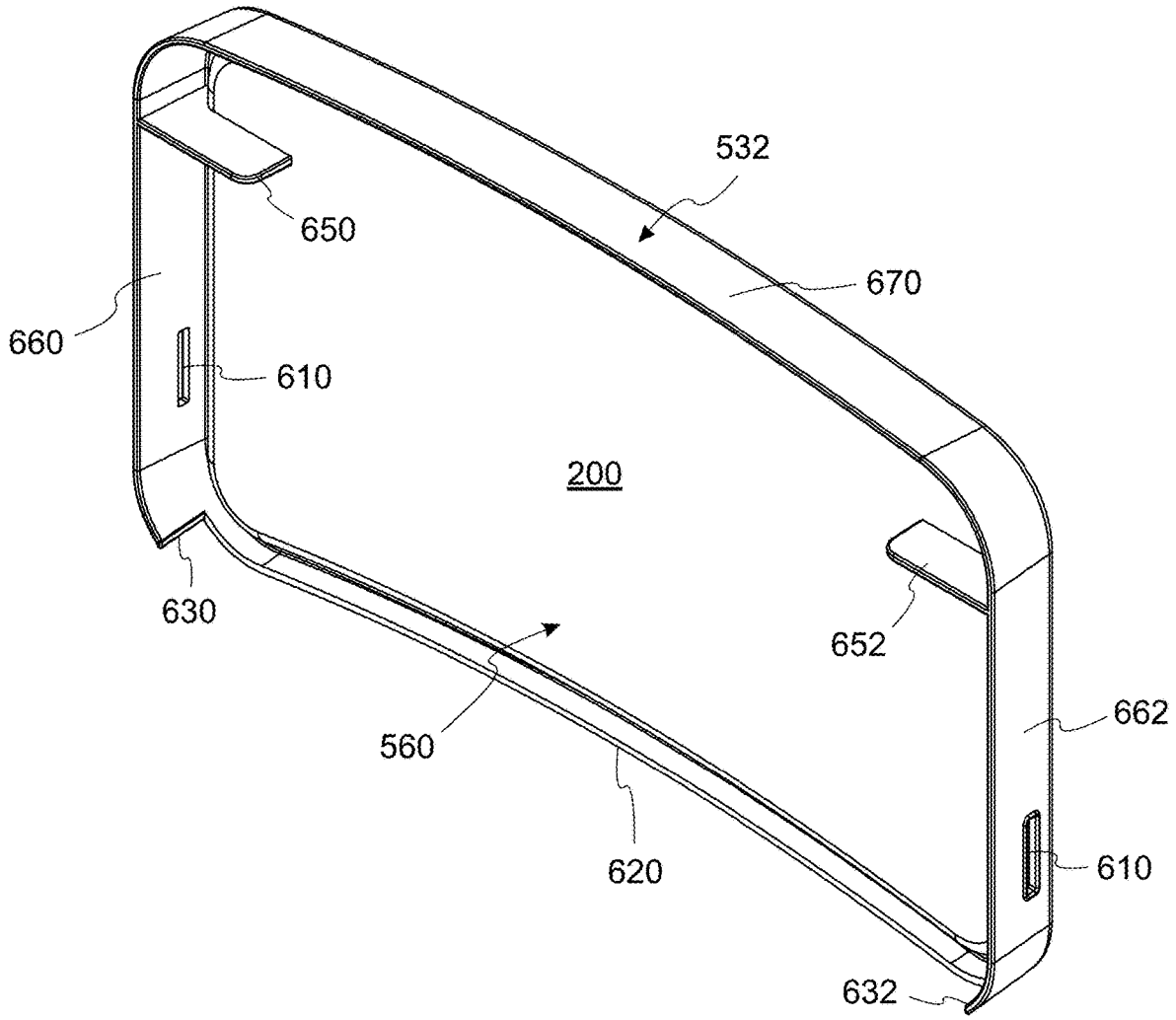
FIG. 6 is a perspective view of the bottom side of the tray assembly of FIG. 2 with securing straps removed.

With further reference to the removed tray assembly 200, as shown in FIG. 5, the strap 310 extends through opposing slots in an apron 532 that projects below the main tray supporting surface 530. One slot captures a shorter strap side 520, and includes a female buckle end 510 on the shorter strap side 520. The opposing slot captures a longer, adjustable strap side 522, and includes a male buckle end 512. The male buckle end 512 allows for a tail 524 in the adjustable strap side 522 that facilitates adjustment of the overall loop around the stringers 142, 144 and seat 140. The shorter strap side 520 is sized in length (e.g. 3-4 inches) to present the male buckle end 510 (and overall buckle assembly 410) on the side of the high chair 100, as shown in FIG. 4, which facilitates easier access by the user for attachment and adjustment. By way of non-limiting example, the length of extension of the shorter strap side 520 is approximately 3 inches and the length of extension of the longer strap side 522 is approximately 36-37 inches. These measurements can be varied in alternate embodiments. Each strap end 520, 522 is anchored within its respective tray slot by a sewn T-shaped stop formation 540, 542, respectively. These structures can be formed using conventional cross-web-sewing techniques. Additionally, the female buckle end 510 is secured to the shorter strap side 520 by a sewn loop 546 is a conventional manner. Sufficient additional web length is provided to each strip side 520, 522 to accommodate sewn structures in a manner clear to those of skill.

An optional pebbled surface texture (defined by phantom lines 550 can be provided to the bottom face 560 of the tray supporting surface 530, where it overlies each armrest to facilitate holding and resist sliding. This also allows for debris and moisture to be channeled away from the bottom face 560. The size of texture features and their shape can be highly varied in alternate embodiments.

With reference now to FIGS. 6-11, the construction of the tray assembly (or simply, "tray") 200 is described in further detail. The tray 200 is constructed from a molded polymer that is compatible with food products. By way of non-limiting example high-density polyethylene (HDPE) is used, but other alternate polymers, such as ABS, PVC, PET, etc., can be used in alternate embodiments. The tray 200 is relatively lightweight, having a weight of under 8 ounces.

Figure 7:
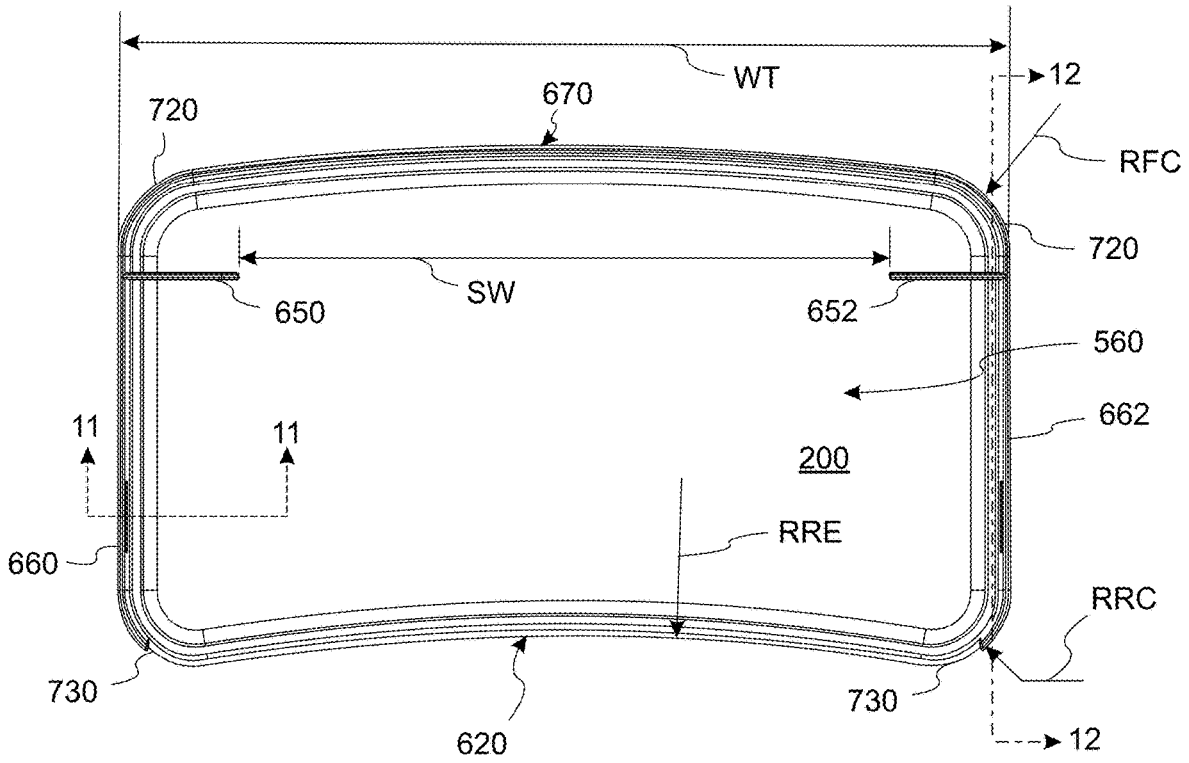
FIG. 7 is a bottom plan view of the tray shown in FIG. 6.
Figure 8:
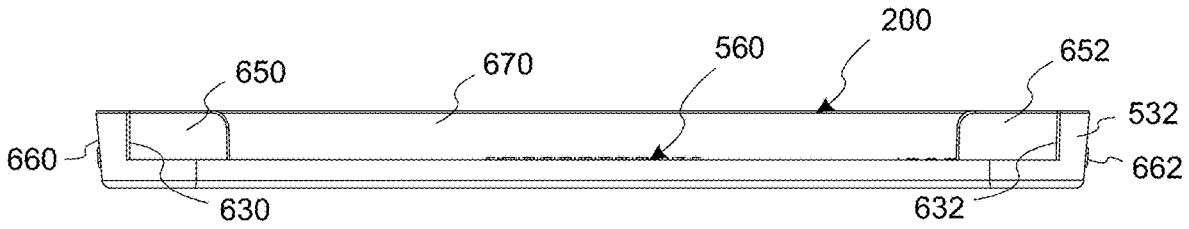
FIG. 8 is a rear view of the tray shown in FIG. 6.
Figure 9:
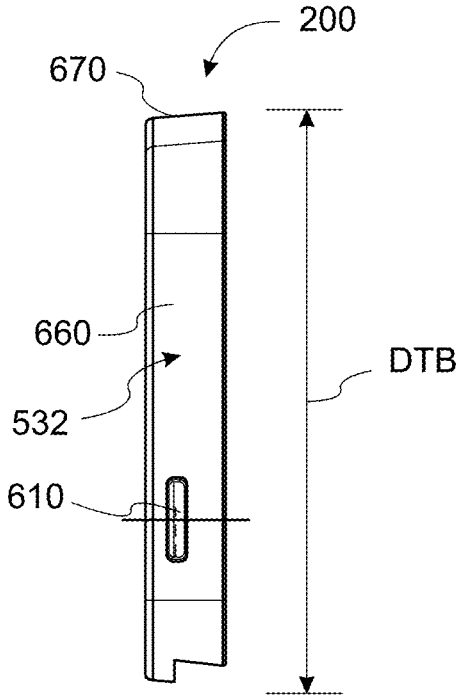
FIG. 9 is a left side view of the tray shown in FIG. 6.
Figure 11:
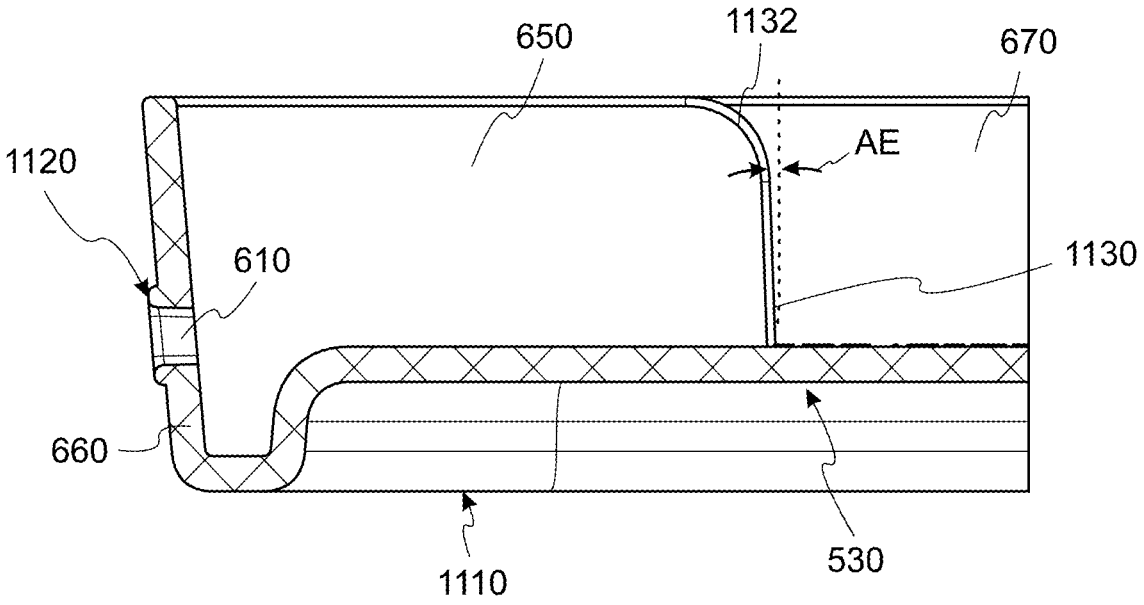
FIG. 11 is partial side cross section of the front corner of the tray, taken along line 11-11 of FIG. 7.
Figure 12:
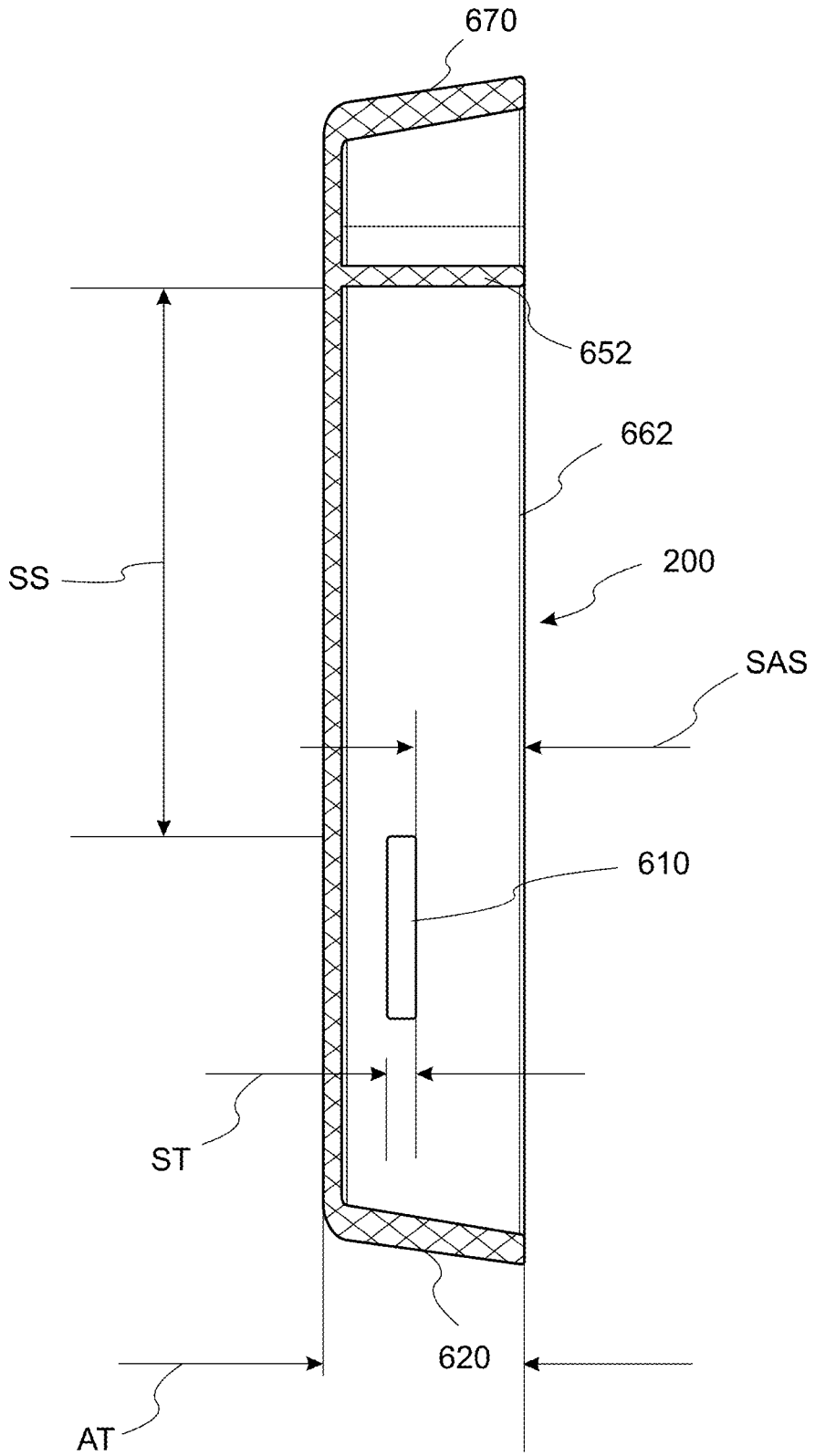
FIG. 12 is a side cross section of the tray side taken along line 12-12 of FIG. 7.

As shown, the apron 532 includes two opposing strap slots 610 of appropriate size and shape to accommodate the straps and prevent slip-out of the T-stops 542, 544 (FIG. 5). The slots 610 are located near the rear edge 620 of the tray 200 to allow for ample room front-to-rear to secure the strap to the high chair armrests 170, 172 and seat 140. As shown in FIG. 12, the slots 610 define an approximate width ST of 0.16 inch and the bottom of each slot 610 is spaced from the bottom of the apron 662 by a distance SAS of approximately 0.6 inch. Notably, the rear edge of the tray 200 defines an edge that is free of a projecting lip or apron. As such, the apron 532 terminates at the rear at opposing edges 630 and 632. This arrangement allows the bottom face 560 to directly confront and engage each armrest 170, 172 of the high chair 100. The bottom face 560 of the tray 200 also supports a pair of opposing, inwardly directed stop walls 650 and 652 that interconnect with the bottom face 560 and each opposing apron sides 660 and 662, respectively. The stop walls 650 and 652 have a height AT (FIG. 12) approximately equal to that of the apron (relative to the surface 560). The stop walls 650, 652 are located front to rear at a location along the tray that allows them to engage front edges of respective armrests on the high chair. They are remote from the front apron 670 to prevent the tray from slipping too far rearwardly while still ensuring a stable support of the tray on the armrests with sufficient clearance room for the child to sit. As shown in FIG. 7, the inner ends of the stop walls are spaced apart by a distance SW of approximately, 10.2 inches, which is sufficient to provide interference against further rearward movement relative to the armrests. The stop walls 650, 652 are spaced SS (FIG. 12) approximately 3.1 inches from the front end of respective slots 610. As shown in FIG. 11, the inner edges 1130 of each stop wall 650, 652 and angled inwardly in an outward direction from the main surface 530 by a slight angle AE of approximately 2 degrees from the vertical (dashed line). This is an optional feature, and along with the rounded corners 1132, serves to soften the overall angles of the tray assembly, in keeping with a product designed for infants and young children.

The tray has an overall width WT (FIG. 7) of approximately 14 inches and an overall Depth DTT (FIG. 10) of approximately 8.2 inches. The depth dimension DTB taken from the side (FIG. 9) is approximately 8.1 inches. The tray further defines a rear edge 620 with a concave surface profile that allows greater room around the seated child's body. By way of non-limiting example, the rear edge 620 defines an approximate radius RRE (FIG. 7) of approximately 34 inches. The front edge 670 defines a convex radius of similar radius to the rear edge for aesthetic and functional purposes. The front corners 720 include rounded profiles having a radius RFC of approximately 1.4 inches, and the rear corners 730 are, likewise, rounded, defining a radius RRC of approximately 1.2 inches. Again, all stated dimensions are approximate and exemplary of a wide range of possible dimensions for various aspects of the tray (and/or its components) within the understanding of one of skill and the functionality of the tray for its contemplated use with the subject high chair design.

Figure 10:
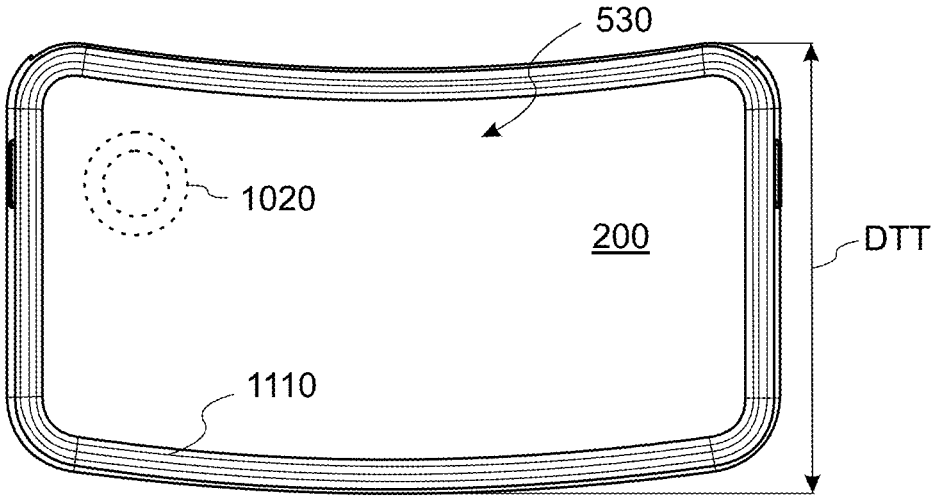
FIG. 10 is a top plan view of the tray shown in FIG. 6.

As shown in FIG. 10, the main supporting surface 530 of the tray 200 surrounded by a raised lip 1110 that prevents minor spills from exiting the surface. The apron is also slightly outwardly flared toward the bottom to assist in preventing spilled liquid from running under the tray and provide additional structural support to the overall tray construction. The molded construction of the tray allows for additional raised features and structures. For example, an optional raised cup holder 1020 (shown in phantom) of appropriate diameter can be formed on the surface 530. Additionally, a raised boss 1120 is provided around the outside of each slot 610 to avoid sharp edges, allow for easier threading of straps therethrough and reducing fraying.

In operation, the user, places and secures his or her child in high chair using the high chair restraining system, and then positions the tray on the armrests, typically with the stop walls engaged against the front edges of the armrests, or slightly forward of the arm rests where extra room is needed. The user then runs the strap around the bottom of the seat and fastens the two ends of the buckle assembly. Any slack in the now-completed loop of web is removed as the tail of the strap is pulled to tighten the loop. The tray is now secured in place and ready for use. Removal of the tray entails releasing the buckle and withdrawing the tray from the high chair. Note that is contemplated that high chair typically includes straps or other integrated restraining devices for the child, and thus, the tray is not provided as part of the restraint system in the illustrative embodiments.

It should be clear that the above-described tray assembly provides a highly portable, easy-to-use implement for enhancing the utility of typical restaurant and institutional high chairs. The design is readily cleaned, having no moving parts except for two washable straps that can be removed for cleaning when desired.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, while the buckle assembly herein defines male and female snap-fit members, a variety of releasable clasping arrangements can be used including traditional belt buckles, simple loop clasps, and/or hook and loop material, and thus, the term "buckle" should be taken broadly to include such releasable clasping mechanisms. Additionally, while the tray defines a unitary molded (or otherwise Also, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A tray assembly for a non-adjustable commercial high chair comprising:

a polymer tray having a main surface and a surrounding apron located continuously around a front and sides thereof, and a rear side free of apron so as to define a clearance region permitting direct engagement of a bottom face of the main surface with a top surface of armrests of the commercial high chair, wherein the bottom face extends continuously laterally to engage with at least a portion of the top surface of the armrests;

a pair of opposing stop walls disposed rearward of the front and extending vertically from the bottom face and inwardly along the bottom face from the apron of each side, the stop walls sized and arranged to have a rear surface thereof engage with front edges of each of the armrests coincident with the direct engagement of the bottom face to the top surface of the armrests, thereby defining a predetermined front-to-rear position of the tray with respect to the high chair; and a strap assembly extending through a slot formed rearward of the stop walls in the surrounding apron on each of the sides and configured with an anchor feature that retains the strap in each of the slots, and having a buckle arrangement that allows the strap assembly to be releasably attached around a seat of the high chair to removably secure the bottom face of the tray through a substantially downward retention force directly to the tops of the armrests of the high chair.

2. The tray assembly as set forth in claim 1, wherein the stop walls that engage front edges of each of the armrests, extend below the tray a height equal to that of the apron.

3. The tray assembly as set forth in claim 2, wherein a top face of the main surface includes a surrounding, continuous raised lip.

4. The tray assembly as set forth in claim 3, wherein the bottom face includes a textured surface that confronts each of the armrests.

5. The tray assembly as set forth in claim 3, wherein the rear side defines a concave curve.

6. The tray assembly as set forth in claim 3, wherein the front side defines a convex curve.

7. The tray assembly as set forth in claim 3, wherein the strap assembly includes two strap sides, each of the strap sides being attached through the slot on each side of the tray.

8. The tray assembly as set forth in claim 7, wherein the strap sides each include a sewn T-shaped end that engages each of the slots, respectively.

9. The tray assembly as set forth in claim 1, wherein the high chair comprises a non-adjustable wooden frame defining a truncated pyramid shape.

10. The tray assembly as set forth in claim 1, wherein the polymer tray is constructed from at least one of HDPE, ABS, PVC, and PET as a unitary molded construction including the stop walls.

11. A method for attaching a tray assembly to a non-adjustable commercial high chair comprising the steps of:

providing, a polymer tray having a main surface and a surrounding apron located continuously around a front and sides thereof, and a rear side free of apron so as to define a clearance region permitting direct engagement of a bottom face of the main surface with a top surface of armrests of the commercial high chair, a pair of opposing stop walls disposed rearward of the front and extending vertically from the bottom face and inwardly along the bottom face from the apron of each side, the stop walls having a rear surface thereof, and a strap assembly extending through a slot formed rearward of the stop walls in the surrounding apron on each of the sides and configured with an anchor feature that retains the strap in each of the slots, and having a buckle arrangement;

engaging the tops of the armrests of the commercial high chair with the bottom face that extends continuously laterally to engage with at least a portion of the top surface of the armrests;

positioning the polymer tray so that the rear surface of the stop walls interfere with front edges of each of the armrests in a predetermined front-to-rear position of the tray with respect to the high chair; and releasably attaching the strap assembly around a seat of the high chair to removably secure the bottom face of the tray, through a substantially downward retention force directly to the tops of the armrests of the high chair with the buckle arrangement.

12. The method as set forth in claim 11, wherein the high chair comprises a non-adjustable wooden frame defining a truncated pyramid shape.

13. The method as set forth in claim 12, wherein the step of releasably attaching includes fastening each of two interengaging buckle members and tightening a free end of at least one strap to remove slack from the buckled strap assembly.

14. The method as set forth in claim 12, wherein the step of releasably attaching includes unfastening each of two interengaging buckle members and removing the polymer tray from engagement with the non-adjustable commercial high chair.

* * * * *